US006819970B2

(12) United States Patent
Turner

(10) Patent No.: US 6,819,970 B2
(45) Date of Patent: Nov. 16, 2004

(54) CONTINUOUS PATH MOULDING MACHINE

(75) Inventor: John Charles Turner, Castle Hill (AU)

(73) Assignee: Ludowici Packaging Limited, Hamilton (NZ)

( * ) Notice: Subject to any disclaimer, the term of this patent is extended or adjusted under 35 U.S.C. 154(b) by 115 days.

(21) Appl. No.: 10/266,089

(22) Filed: Oct. 3, 2002

(65) Prior Publication Data

US 2004/0067273 A1 Apr. 8, 2004

(51) Int. Cl.[7] ..... B29C 39/44; D21F 11/00; D21J 3/00

(52) U.S. Cl. ..... 700/128; 700/197; 162/218

(58) Field of Search ..... 700/112–114, 122, 700/127, 128, 197–199, 206–208; 162/218–227, 252, 253, 256, 262

(56) References Cited

U.S. PATENT DOCUMENTS

| | | | | | |
|---|---|---|---|---|---|
| 5,403,447 | A | * | 4/1995 | Jarvinen et al. | 162/358.1 |
| 5,685,955 | A | * | 11/1997 | Leigraf et al. | 162/198 |
| 6,290,816 | B1 | * | 9/2001 | Graf | 162/253 |
| 6,482,296 | B1 | * | 11/2002 | Fagerlund et al. | 162/253 |
| 6,564,117 | B1 | * | 5/2003 | Chen et al. | 700/129 |
| 6,574,520 | B1 | * | 6/2003 | Liu et al. | 700/96 |
| 2003/0171838 | A1 | * | 9/2003 | Chen et al.. | 700/128 |

FOREIGN PATENT DOCUMENTS

| | | |
|---|---|---|
| NZ | 113979 | 2/1957 |
| NZ | 121548 | 5/1959 |
| NZ | 140909 | 5/1966 |

* cited by examiner

*Primary Examiner*—Maria N. Von Buhr
(74) *Attorney, Agent, or Firm*—Knobbe, Martens, Olson & Bear, LLP

(57) ABSTRACT

A continuous-path moulding machine for moulded articles, including at least one moulding or forming die moving continuously or stepwise forward on a primary path and at least one transfer or pressing die moving continuously or stepwise forward on a secondary path, wherein at least one said path is a continuous-path loop, the arrangement being such that a component on said continuous-path loop passes a given fixed point on said continuous-path loop repeatedly, and wherein a plurality of discrete reference positions are provided on at least said primary path, and wherein said reference positions generate at least one position signal, and wherein said at least one position signal is transmitted to at least one DIOC, and wherein said DIOC includes associated customised software containing "if-then" type instructions, and wherein at least one communication system is provided to enable signals to be communicated from a stationary component of said machine to at least one component on a path of said machine to maintain real time relationship and positional control between said at least one die on a primary path and secondary path while said machine is operating.

14 Claims, 1 Drawing Sheet

RECORD OF REAL TIME RELATIONSHIP AND POSITIONAL CONTROL ACHIEVED BETWEEN A MOULDING DIE AXIS AND TRANSFER DIE AXIS OVER A 1200 SECOND PERIOD OF ELAPSED TIME

CONTINUOUS PATH MOULDING MACHINE

BACKGROUND OF THE INVENTION

1. Field of the Invention

This invention relates to moulding machines and has been devised particularly but not solely to provide moulding machines for the manufacture of articles from fibrous suspensions, such as suspensions of cellulose or synthetic polymer fibres or mixtures of such fibres, and especially from lignocellulose fibres such as are used in papermaking, and the fibre recovered from recycled waste paper.

The invention may also be used in the manufacture of moulded articles generally, wherein the moulded articles are formed upon, and take their shape from a die or a set of dies, using materials such as fibrous suspensions and thermoplastic sheet.

The invention and prior art is described by way of example, using the manufacture of articles by moulding from fibrous suspensions, but the invention may also be employed to advantage in manufacture by thermoforming from thermoplastic polymer sheet.

2. Description of the Related Art

In background articles may be moulded from fibrous suspensions, the fibre or fibrous mixture suspended in a fluid, to be deposited on the surface of a porous mould or die, the fluid passing through the pores, leaving the fibres behind to form the desired shape on the working surface of the mould or die.

The fluid commonly used to suspend the fibre is water, in a so-called wet forming process, with the suspension loosely referred to as pulp. Steam and/or air and/or other gases may also be used as the fluid, in which case the process is described in the art as a dry or semi-dry forming process. An advantage of water is that it has the ability to suspend the fibre reliably in the form of a pulp feedstock during preparation and storage, and delivery to the moulding machine, enabling the convenient inclusion of various additives both to advantageously modify the moulding process on the moulding machine and also the properties of the moulded article to suit various end uses. When the fibre is or contains lignocellulosic fibre such as papermaking fibre which may be recovered from waste paper for example, another advantage of water is that it enables hydrogen bonds to be developed between the fibres, either as the only bond or in association with other adhesives so connecting the fibres together at junctions in the completed article, hydrogen bonds being the principle bonding means used by papermakers.

In a dry forming process, additional adhesive is invariably required unless the article is held under pressure at a temperature high enough to fuse the natural polymers (principally the lignin) in the formed mass, because significant hydrogen bonding is not developed in a dry forming process.

While water is the most common medium used to transport fibres for moulding it also has some disadvantages and the main disadvantage of water is that when the fibres have been deposited on the mould or die surface, substantial energy is required to remove the water again to produce a usefully rigid article.

The source of lignocellulose fibre most commonly used is recycled waste paper although virgin fibre or a fibre mixture may also be used, including various polymer fibres which of course do not develop hydrogen bonds. When present in large proportions or as the sole fibre, polymer fibres may be bonded by fusing with heat.

After removal of sufficient water by draining, pressing, and the like, to enable the moulded article to be further processed it is transferred directly or by means of a co-acting transfer die or dies of a shape generally matching the moulding die, to a drying facility, where further water is removed using heat. In a dry forming process the dies may be heated to cure a bonding agent. A drying facility may be used, which is typically an oven, including a conveyor onto which the moulded article is deposited, to be conveyed through the oven, to emerge as the dried or cured rigid article of a substantially predetermined moisture content.

In practice, although the moulding process can be accomplished with a single moulding die with or without a single transfer die, the moulding machine more usually includes a plurality of moulding dies and a plurality of transfer dies to effect moulding and transfer of the articles more or less continuously at a satisfactory production rate. Sometimes a lesser number of transfer dies than moulding dies is used, each transfer die serving more than one moulding die, but nevertheless with generally matching shapes and the dies co-acting in sets. The plurality of moulding dies are arranged to move on a path which includes immersing them into a vat of the suspended pulp feedstock to collect or form the moulded article on the porous moulding surface of the die, and the plurality of transfer dies (where used) are also arranged to move on a separate path which includes engaging in co-acting sets with the moulding dies to effect transfer of the moulded articles prior to drying them, or in the case of a dry forming process, to press the article and apply heat to cure a bonding agent.

During engagement of co-acting sets any separate paths must be parallel for a time, and the die sets must be moving at similar speeds to remain properly engaged and this necessity places significant limitations on prior art moulding machines of the continuous-path type, especially where the article requires moulding of deep cavities.

Separate pressing dies may be used either to improve the shape or finish of the article or to provide conditions to bond the moulded material together. When the pressing process is performed on the moulding line the separate pressing dies also have to be coordinated with the other functions of the moulding machine.

The simplest form of a moulding machine arrangement is a reciprocating system with the moulding die or dies reversing repeatedly on a path to accomplish the process. This form of moulding machine is relatively simple to control as the path is usually linear and there are end positions at each end of the path. The reciprocating moulding machine solution is usually applied to comparatively low volume production, often for deep cavity mouldings, and has an advantage of simplicity and low capital cost for such purposes.

For large scale production the common prior art solution is to provide continuous-paths for the dies to follow by mounting them on a rotating framework or rotor, for example a moulding die rotor and a transfer die rotor, which are permanently mechanically interconnected so as to keep them in the correct relative positions throughout the sequences, the rotors usually moving continuously at a constant speed during the production process. The essential sequences of operations required for moulding machines with continuous-path mounted dies become much more difficult to provide and control and the prior art versions of these machines are not suited to deep cavity mouldings, mainly because of interference between moulding and transfer dies as they enter and leave cavities while moving on a non-linear path. Irrespective of whether or not transfer dies are used, the wet articles may also be required to be deposited accurately on a conveyor passing through a drying oven, especially where dryer trays are used. This requires yet further co-ordination. Often a subsidiary function of the transfer dies is pressing to achieve mechanical compaction and accuracy of shape of the article and removal of some water by squeezing prior to a further drying stage, or application of heat in a dry forming process.

Associated with the need for correct register of the moulding and transfer dies are functions such as the application of alternating vacuum and pressure to the moulding dies at the appropriate time to draw fluid through holes provided in order to form the pulp feedstock on the porous working face and effect transfer of the moulded article respectively, and application of alternating vacuum and pressure pulses to the transfer dies (which are also provided with holes), at the appropriate times to effect transfer of the moulded article, and release of the article for placement for drying or stacking. In addition, water sprays and air showers are often provided in order to clean the dies, to assist in transfer or positioning of the article at various stages of the process and to "wash" the product to improve its surface finish and edge definition. The functions must all take place at the correct stage in a predetermined sequence to accomplish reliable and continuous manufacture of the article.

Various solutions are provided in the prior art to accomplish the sequences and some examples of embodiments of the common moulding machines used are disclosed in New Zealand patents, 113979 121548, and 140909 by Keyes Fibre Company who have operated such machines in the past through their licensees in New Zealand, and in other countries. Moulding machines of these general designs are widely used in the pulp moulding industry worldwide and have been generally unchanged for many years.

Relative movement together and accurate positioning of moulding dies and transfer dies is accomplished in the prior art by the use of mechanical cams which track the transfer dies along a common or parallel path and at the same speed as the moulding dies for a sufficient path length to effect transfer of the article, and because relatively large mechanical forces are involved, the cam tracks and cam followers and all the associated components, have to be of very robust and heavy construction. They not only become expensive but once configured are very difficult and time consuming to change, except perhaps by modification or replacement during a major machine re-fit. Secondary cams and/or levers are also provided to operate valves for application of vacuum, water, and pressure to components at the correct stage of the sequence. The cams and the configuration of the paths followed by the components on the moulding machine also predetermine the range of cavity depth that can be moulded on a particular machine. Once set up, the functions are generally insensitive to operating variables such as pulp consistency, temperature, and changes in the waste paper feedstock for example, and all of these things can directly affect the quality and utility of the finished article as well as the production speed. When a plurality of moulding dies are fitted to such a machine they must all be very similarly matched since the process is a compromise which does not allow several different articles with different moulding characteristics to be produced in the same production run.

When the moulding machine is in production it requires constant monitoring and attention by operators who are able to make only limited on-the-run adjustments, due to the rigid mechanical interconnections of the machine design. Changes are made to the pulp consistency and machine speed and various pressures in order to produce articles within the predetermined product specifications and quality, and these require the attention and decisions of a skilled operator. A breakdown can typically involve loss of a mechanical connection and loss of co-ordination between the components and functions, and often serious mechanical damage to the moulding machine, including the dies should they come together in the wrong way.

With moulding machines of a continuous-path type particularly, it not only becomes difficult to provide the solutions to co-ordination of the various functions but it becomes very difficult or impossible to tune or adjust the various coordinated and sequenced functions on-the-run in order to maximise production and article quality. Even the behaviour of the individual dies in a set can be different due to slight variations in them and their position on the machine and in the prior art adjustments for differences at this level become a complex and time consuming job for a skilled technician. Operators must always be present to make compromises based on their skill and experience, and make the limited adjustments possible to machine speed, pulp consistency, vacuums, pressures, and the like in order to maintain satisfactory manufacture.

SUMMARY OF THE INVENTION

Thus, it is an object of this invention to provide continuous-path moulding machines which overcome or minimise at least some of the forgoing disadvantages in a simple and cost effective manner.

It is a further object of this invention to provide continuous-path moulding machines with predetermined self-correcting operating capabilities, capable of operating for extended periods without operator intervention and capable of remote monitoring and control.

It is a further object of this invention to provide continuous-path moulding machines with greater versatility and reliability than prior art moulding machines or to at least provide the public with a useful choice.

Accordingly, in one broad form of the invention, there is provided a continuous-path moulding machine (as defined herein) for manufacture of moulded articles, including at least one moulding or forming die moving continuously or stepwise forward on a primary path and at least one transfer or pressing die moving continuously or stepwise forward on a secondary path, and wherein at least one said path is a continuous-path loop, the arrangement being such that a component on said continuous-path loop passes a given fixed point on said continuous-path loop repeatedly, and wherein a plurality of discrete reference positions are provided on at least said primary path, and wherein said discrete reference positions generate at least one position defining signal on said primary path, and wherein said at least one position defining signal is transmitted to at least one DIOC (as defined herein), and wherein said DIOC includes associated customised software containing "if-then" type instructions (as defined herein), and wherein at least one communication system is provided to enable signals to be communicated from a stationary component of said continuous-path moulding machine to at least one component on a path of said continuous-path moulding machine to maintain real time relationship and positional control between said at least one moulding or forming die on a primary path and said at least one transfer or pressing die on a secondary path while said continuous-path moulding machine is operating to produce moulded articles.

Preferably said primary path is a continuous-path loop.

Preferably said secondary path is a continuous-path loop.

Preferably a plurality of discrete reference positions are provided on said secondary path, and wherein said discrete reference positions generate at least one position defining signal, and where said at least one position defining signal is transmitted to at least one DIOC, and wherein said at least one DIOC includes associated customised software containing "if-then" type instructions.

Preferably said at least one DIOC receives at least one position defining signal transmitted from a primary path of said continuous-path moulding machine and at least one position defining signal transmitted from a secondary path of said continuous-path moulding machine.

Preferably said communication system is selected from a slip-ring system, a rail and conducting brush or shoe system, a slip-disk and conducting brush system, an infra-red or visible spectra light beam system, or a radio frequency signal system.

Preferably said communication system is a slip-ring or slip-disk system.

Preferably said discrete reference positions are identified one from another reference position.

Preferably said discrete reference positions are identified one from another reference position by counting each reference position from a datum or base reference position.

Preferably said discrete reference positions are positively identified one from another reference position by each being provided with a unique code.

Preferably said code is characterised by a signal frequency or intensity.

Preferably said code is characterised as a digital code.

Preferably said digital code is selected from a simple binary code, a binary code decimal, or a variation of a binary code decimal known in the art as Gray Code.

Preferably said discrete reference positions are provided by one or more rotary encoding devices.

Preferably one or more rotary encoding devices are directly mechanically connected to a shaft having a reliable and accurate rotational relationship to the movement of a primary or secondary path of said continuous-path moulding machine.

Preferably one or more rotary encoding devices are directly mechanically connected to a mainshaft having a 1 to 1 relationship to a primary or secondary path of said continuous-path moulding machine.

Preferably one or more rotary encoding devices are driven faster than the continuous path to which they relate so as to multiply the number of codes or pulses for each revolution of said one or more rotary encoding devices to enhance the number and resolution of discrete reference positions on a continuous path loop of said continuous-path moulding machine.

Preferably a primary path and a secondary path are provided with a conventional mechanical connection therebetween to establish and maintain a positive positional relationship between said primary path and said secondary path of said continuous-path moulding machine.

Preferably said continuous-path moulding machine includes at least one primary continuous-path loop and at least one secondary continuous-path loop, wherein discrete reference positions are provided by at least one encoding device associated with each of a primary continuous-path loop and a secondary continuous-path loop to generate a plurality of position defining signals from said at least one encoding device associated with each continuous-path loop and wherein said position defining signals are input to and sampled at substantially predetermined intervals by at least one common DIOC, said common DIOC including customised software containing "if-then" type instructions, and wherein positional errors between a primary continuous-path loop and a secondary continuous-path loop are determined by comparisons between actual positions as indicated by said position defining signals and target positions as defined in said customised software, said positional errors initiating a response of output correction signals at a substantially predetermined interval frequency to closed servo loop operating system including servo amplifiers driving associated servo motors on both a primary continuous-path loop and a secondary continuous-path loop to maintain real time relationship and positional control between a primary continuous-path loop and a secondary continuous-path loop of said continuous-path moulding machine while said continuous-path moulding machine is operating to produce articles.

Preferably said substantially predetermined interval frequency is between 50 and 2500 times per second.

Preferably said substantially predetermined interval frequency is between 1000 and 2000 times per second.

Preferably said DIOC includes one or more common personal computers fitted with at least one data acquisition and control input/output card.

Preferably said DIOC includes one or more programmable logic controllers, commonly known in the art as a PLC.

Preferably said DIOC includes an interface with at least one other personal computer to enable monitoring of said continuous-path moulding machine while said continuous-path moulding machine is operating to produce articles.

Preferably said at least one personal computer is adapted to enable changes to be made to said associated customised software containing "if-then" type instructions while said continuous-path moulding machine is operating to produce articles.

Preferably said interface includes a modem for transmission of data between said at least one DIOC and said at least one personal computer.

Preferably said at least one personal computer is located at a distant site, remote from said continuous-path moulding machine.

Preferably transmission of data between said at least one DIOC and said at least one personal computer includes a telephone link.

Preferably transmission of data between said at least one DIOC and said at least one personal computer includes a radio link.

Preferably at least one moulding or forming die moves stepwise forward on a primary path.

Preferably at least one transfer or pressing die moves stepwise forward on a secondary path.

BRIEF DESCRIPTION OF THE DRAWINGS

Embodiments of the invention which includes the forgoing will now be described by way of example with reference to FIG. 1 which shows a record of the real time relationship and positional control achieved between a moulding die axis and a transfer die axis of a continuous path moulding machine according to the invention over a 1200 second period of elapsed time when operating to produce articles such as those commonly known as moulded fibre or moulded pulp articles.

DETAILED DESCRIPTION OF THE PREFERRED EMBODIMENT

Figure 1:
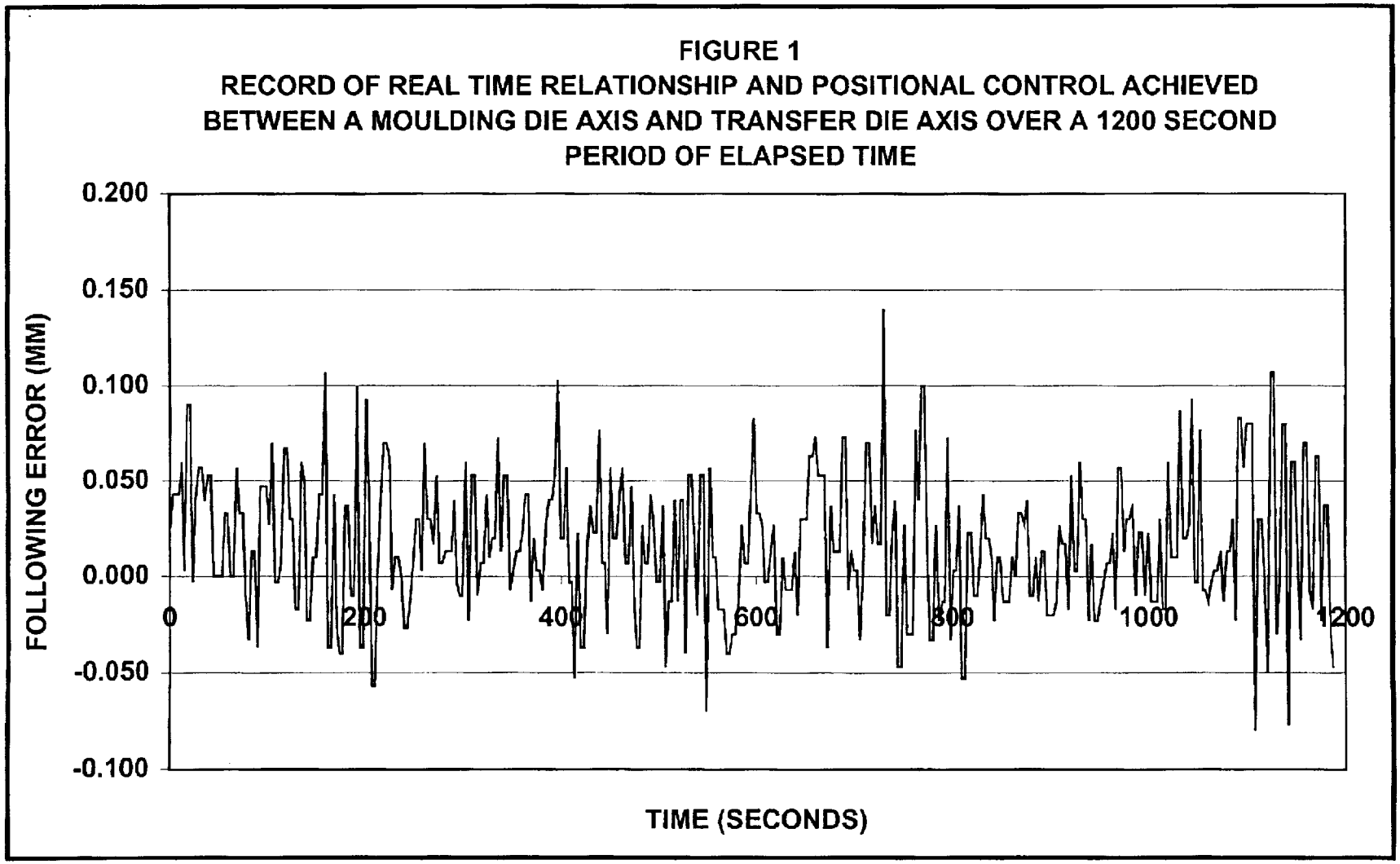

Throughout this specification reference is made to a "continuous-path moulding machine'" which for the purpose of this specification is defined as a moulding machine wherein at least one moulding or forming die and associated components move with a continuous or intermittent forward motion on a primary path, and wherein at least one transfer or pressing die moves with a continuous or intermittent forward motion on a secondary path, and wherein at least one said path is a continuous-path loop, the arrangement being such that a component on said continuous-path loop passes a given fixed point on said continuous-path loop repeatedly when said moulding machine is operating to produce moulded articles.

Typically, and in the invention a continuous-path moulding machine (as defined herein) has one or more sets of moulding dies fitted to it (usually a plurality of moulding dies), the die sets, comprising at least moulding dies and transfer or pressing dies, being changed at times when it is desired to produce different moulded articles.

Throughout this specification reference is also made to a digital input/output controller and for the purpose of this specification a digital input/output controller (DIOC) is defined as a computing device including at least one Central Processing Unit (a CPU as well known in the art of computer technology) and supporting circuit board (also well known in the art as a Motherboard or Backplane) and with an input/output circuit facility to enable independent external communication both to and from a continuous-path moulding machine and/or the continuous-path moulding machine peripheral supporting equipment, and a memory capability containing customised software including if-then type instructions.

Throughout this specification when reference is made to "if-then" type instructions they are defined for the purpose of this specification as instructions in customised software which recognises that if certain software defined conditions or combinations of conditions exist, as indicated by an input signal or signals received by the at least one DIOC (as defined herein) then a response is generated by the DIOC either to modify the said customised software and/or to output one or more return signals to the continuous-path moulding machine and/or the continuous-path moulding machine peripheral supporting equipment, to modify or initiate functions or settings on the continuous-path moulding machine and/or the peripheral supporting equipment.

The peripheral supporting equipment in the invention may include components such as pumps, air and hydraulic cylinders, valves, motors, heaters, switches and sensors for example, used in preparation and delivery of feedstock to the continuous-path moulding machine, and/or in the control and management of moulded articles produced by the continuous-path moulding machine.

According to one aspect of the invention there is provided a continuous-path moulding machine for manufacture of moulded articles, including at least one moulding or forming die moving continuously or stepwise forward on a primary path, and at least one transfer or pressing die moving continuously or stepwise forward on a secondary path, and wherein at least one said path is a continuous-path loop, the arrangement being such that a component on said continuous-path loop passes a given fixed point on said continuous-path loop repeatedly, and wherein a plurality of discrete reference positions are provided on at least one path, and wherein said discrete reference positions generate at least one position defining signal on said path, and wherein said at least one position defining signal is transmitted to at least one DIOC, and wherein said DIOC includes associated customised software containing "if-then" type instructions, and wherein at least one communication system is provided to enable signals to be communicated from a stationary component of said continuous-path moulding machine to at least one component on a path of said continuous-path moulding machine to maintain real time relationship and positional control between said at least one moulding or forming die and said at least one transfer or pressing die while said continuous-path moulding machine is operating to produce moulded articles.

According to another aspect of this invention there is provided a continuous-path moulding machine for manufacture of moulded articles, including at least one moulding die moving continuously or stepwise forward on a primary continuous path loop, said at least one moulding die passing a given fixed point on said primary continuous-path loop repeatedly, and wherein a plurality of discrete reference positions are provided on said primary continuous-path loop, and wherein said discrete reference positions generate at least one position defining signal on said primary continuous-path loop and wherein said at least one position defining signal is transmitted to at least one DIOC, and wherein said DIOC include associated customised software containing "if-then" type instructions, and wherein at least one communication system is provided to enable signals to be communicated from a stationary component of said continuous-path moulding machine to at least one component on a path of said continuous-path moulding machine to maintain real time relationship and positional control between said at least one moulding die and said at least one component, and of other sequenced functions of the moulding process while said continuous-path moulding machine is operating to produce moulded articles.

According to another aspect of this invention there is provided a continuous-path moulding machine for manufacture of moulded articles, including at least one transfer or pressing die moving continuously or stepwise forward on a secondary continuous path loop, said at least one transfer or pressing die passing a given fixed point on said secondary continuous-path loop repeatedly, and wherein a plurality of discrete reference positions are provided on said secondary continuous-path loop, and wherein said discrete reference positions generate at least one position defining signal on said secondary continuous-path loop and wherein said at least one position defining signal is transmitted to at least one DIOC, and wherein said DIOC include associated customised software containing "if-then" type instructions, and wherein at least one communication system is provided to enable signals to be communicated from a stationary component of said continuous-path moulding machine to at least one component on a path of said continuous-path moulding machine to maintain real time relationship and positional control between said at least one transfer or pressing die and said at lease one component and of other sequenced functions of the moulding process while said continuous-path moulding machine is operating to produce moulded articles.

According to another aspect of the invention there is provided a continuous-path moulding machine for manufacture of moulded articles, including at least one moulding or forming die moving continuously or stepwise forward on a primary continuous-path loop, said at least one moulding or forming die passing a given fixed point on said primary continuous-path loop repeatedly, and also including at least one transfer or pressing die moving continuously or stepwise forward on a secondary continuous-path loop, said at least one transfer or pressing die passing a given fixed point on said secondary continuous-path loop repeatedly and wherein a plurality of discrete reference positions are provided on at least said primary continuous-path loop and wherein said at least one position defining signal is transmitted from said plurality of discrete reference positions to at least one DIOC, and wherein said DIOC includes associated customised software containing "if-then" type instructions, wherein at least one communication system is provided to enable signals to be communicated from a stationary component of said continuous-path moulding machine to a component moving on a path of said continuous-path moulding machine to maintain real time relationship and positional control between said at least one moulding or forming die and said at least one transfer or pressing die and of other sequenced functions of the moulding process while said continuous-path moulding machine is operating to produce articles.

It should be appreciated that a path or paths may be any particular shape to suit. For example a path may be discontinuous or continuous. A path may be straight, curved, generally circular, elliptical or contorted in some way to facilitate functions to advantage on a particular moulding machine.

In the invention the primary path or a secondary path of a continuous-path moulding machine may be a continuous-path loop, and the plurality of discrete reference positions provided on a path of a continuous-path moulding machine may be provided on any one or more paths of a continuous-path moulding machine.

In the invention the plurality of discrete reference positions on a path of a continuous-path moulding machine need not be evenly spaced on the particular path provided the position of each is known with sufficient precision such as normally accepted engineering tolerances for machines, and provided each reference position can be identified one from another reference position. The discrete reference positions may be provided directly on the primary and/or the secondary paths themselves or on shafts such as main shafts or layshafts or motor shafts permanently mechanically connected to the path or paths so that the reference positions have substantially permanent relationship to the positions on their respective paths. Preferably, but not essentially, the discrete reference positions are evenly spaced on a path within practical engineering tolerances but they need not be so spaced.

In the invention each of the plurality of discrete reference positions on a path of a continuous-path moulding machine is identifiable one from another and in one form of the invention the discrete reference positions may be identified by counting each reference position from a datum or base reference position, the datum or base reference position being confirmed during cycles of components moving on a path. In another form of the invention the discrete reference positions on a path may be positively identified by each being provided with a unique code. A code when provided, may for example, be a digital code for each discrete reference position, directly identifiable by the DIOC customised software, such as a simple binary code (BC), a binary code decimal (BCD), or a variation of binary code known in the art as Gray Code (GC) which simplifies encoding because it requires only one "bit" changes between adjacent discrete reference positions for positive identification. The Gray Code enables a larger number of discrete reference positions to be uniquely identified with a given number of "bits". As an alternative to digital code identification, each discrete reference position may be identified by means of a characterised signal, the signal being characterised by frequency or intensity for example, which may be sorted by a suitable filter or filters, to enable identification of a position by the DIOC customised software.

In one preferred form of the invention the discrete reference positions are identified by counting each reference position incrementally from a zero or base reference position on a path, the zero or base reference position being confirmed for repeated cycles on said path. This has been found to be a simple and reliable method to identify the discrete reference positions on a path, and therefore the position of all of the components on a path at any time instant since the configuration of all of the components one to each other is already known for the moulding machine.

Rotary encoding devices have been found to be particularly suitable for defining the discrete reference positions necessary in the invention, although other means may also be used. One or more rotary encoding devices may be directly mechanically connected to a shaft having a reliable rotational relationship to the movement of a primary or secondary path of the continuous-path moulding machine, such as a mainshaft or a motor driving said mainshaft, or to a layshaft meeting the requirement of a reliable rotational relationship to the movement of the particular path.

In a simple form of the invention a rotary encoding device is directly connected to a mainshaft having a 1 to 1 relationship to a primary or secondary path of the continuous-path moulding machine. In another form of the invention a rotary encoding device is driven faster than the particular path it relates to so as to multiply the number of codes or discrete reference positions available on the path for identification of positions on the path.

When the rotary encoding device is mechanically connected to a motor driving a mainshaft or to a layshaft on a continuous-path moulding machine according to the invention, the rotational relationship between the motor driving a mainshaft or a layshaft and the movement of the continuous-path loop need not be a ratio of 1 to 1, and in another form of the invention a rotary encoding device is driven faster than the continuous-path loop so as to multiply the number of codes or pulses per revolution, and thus enhance the resolution or definition of discrete positions on the continuous-path loop.

Several suitable rotary encoding devices are available, and among these for example are rotary encoding devices supplied by the Lucas™ group of companies for example in a range of resolutions including up to 10,000 pulses (for incremental encoders) and 4,096 codes (for absolute encoders) per revolution. The incremental encoders are suitable for use where the discrete reference positions on a path are identified by counting from a datum reference position according to the invention, and the absolute encoders provide unique signals for each discrete reference position such as the digital codes explained hereinbefore. It has been found that the range of resolutions commercially available is completely adequate for the purpose of the invention, to provide accurate discrete reference positions to enable functions to be performed on the operating continuous-path moulding machine, such as for example, at times when negative or positive pressures are to be applied to said die in order to accumulate the fibre to form the article in the first instance or to actuate transfer of the article to a transfer die, or to release the article for conveying to a drying oven and in one preferred form of the invention to ensure that an exact positional relationship between primary and secondary paths is maintained while the continuous-path moulding machine is operating.

Rotary encoders suitable for use in the invention are also supplied by other makers in both incremental and absolute code types. Depending upon the rotary encoder used the signals representing the discrete reference positions on a path of the continuous-path moulding machine are appropriately interfaced with the at least one DIOC.

In a preferred form of the invention there is provided a continuous-path moulding machine including a primary continuous-path loop with at least one moulding or forming die moving continuously or stepwise forward, co-acting with at least one transfer or pressing die moving continuously or stepwise forward on a secondary continuous-path loop and wherein the separate paths of the dies and the speed of the dies following the primary and secondary path loops are altered so the dies become parallel and correctly registered in the zone of engagement by means of a pneumatic, hydraulic or electric mechanism or plurality of mechanisms connected to the die or dies on the primary and/or the secondary path loops and having no mechanical connection to stationary or moving objects outside of the continuous-path loop on which it or they are mounted. Conventional engineering designs of suitable mechanisms which act in response to output signals from the at least one DIOC (as defined herein) can be employed to carry out functions on the continuous-path moulding machine at the correct time and at the correct rate for proper interaction of the co-acting components of the continuous-path moulding machine while it is in operation producing articles. Essential to the co-acting operation of the said at least one moulding or forming die and the at least one transfer or pressing die, and to the other co-acting components and functions of an operating continuous-path moulding machine according to the invention, a communication system is provided to enable signals to be communicated from a stationary component of said continuous-path moulding machine to a moving component on a path of said continuous-path moulding machine while said continuous-path moulding machine is operating to produce articles. The communication system may be a slip-ring system, a rail and conducting brush or shoe system, an infra-red or visible spectra light beam system, or radio frequency signal system, transmitted between a stationary component of said continuous-path moulding machine and a component on a moving path of said continuous-path moulding machine. With respect to the communication system, and by a system, a compatible transmitting and receiving set of components such as a set comprising one or more electrically conducting rings or disks together with corresponding one or more electrically conducting sliders or "brushes" as known in the art with either said ring or rings or disks, or said sliders or brushes rotating about an axis to maintain an electrical connection, or one or more infra-red or visible light projectors together with corresponding one or more infra-red or visible light photodiodes for example, or one or more radio frequency transmitters together with corresponding one or more radio frequency receivers for example is intended.

A slip-ring or disk system is reliable and suitable for the purpose. Where more than one separate communication channel is required, a ring may be provided with a plurality of conducting juxtaposed tracks, insulated one from another, with corresponding conducting brushes to maintain electrical connection while the system of brush and track components are in relative motion one with another. Likewise, when a disk or disks are used, a plurality of conducting tracks may be provided in a rotatable concentric arrangement about a centre of such a disk. Signals to be communicated to components on a path of the continuous-path moulding machine include signals to actuate air or hydraulic cylinders to extend or retract or otherwise alter the position of the at least one die on the continuous-path, and signals to initiate the application of vacuum and pressure pulses to the said at least one die for example at predetermined stages of a sequence co-ordinated by the at least one DIOC and associated customised software in relation to the at least one position defining signal on the primary or a secondary path of the continuous-path moulding machine.

When a continuous-path moulding machine according to the invention includes a secondary path as well as a primary continuous-path it is necessary that an exact positional relationship be established and maintained between the primary continuous-path loop and a secondary path when the continuous-path moulding machine is operating to produce articles. In one form of the invention a conventional mechanical connection as used in the prior art is provided between the primary continuous-path loop and a secondary path, which may also be a continuous-path loop. Examples of a suitable mechanical connection in this form of the invention are a gear train or roller chain train for example. In this form of the invention, the discrete reference positions and the at least one position defining signal, in association with the DIOC and the customised software, provide complete control over the operation of co-acting components on the primary and secondary paths of operating continuous-path moulding machine, including fail-safe feedback functions, and optional control of associated pumps, valves, and other peripheral components.

In one embodiment of the invention wherein a continuous-path moulding machine includes both a primary continuous-path loop and at least one secondary continuous-path loop it is possible to dispense entirely with a conventional mechanical connection between primary and secondary paths while retaining the essential feature of an exact positional relationship between primary and secondary paths. In this embodiment of the invention discrete reference positions are provided by encoding devices as described hereinbefore and which are associated with both the primary continuous-path loop and a secondary continuous-path loop to generate a plurality of position defining signals which are used as an input to at least one DIOC to maintain real time relationship and positional control between a primary continuous-path loop and a secondary continuous-path loop by means of closed servo loops, providing functions of both initiation of movement and confirmation of an outcome, both of a co-ordinated primary and secondary path, and of the other sequenced functions necessary when the continuous-path moulding machine is operating, so that the operating continuous-path moulding machine remains under comprehensive management at all times.

In this embodiment of the invention, each servo loop, that is to say, at least a servo loop associated with a primary continuous-path loop, and another associated with a secondary continuous-path loop, comprises at least one common DIOC which becomes a master controller receiving position defining signals from each of at least a primary path and a secondary path. The at least one common DIOC, outputs to servo amplifiers which are provided to control torque and/or speed of motors driving components on each path on a continuous-path moulding machine according to the invention. The at least one common DIOC works by sampling the at least one position defining signal on a primary path and a secondary path at intervals and compares the actual positions as indicated by the position defining signals with the target positions defined in the customised software containing "if-then" type instructions. The servo amplifiers driving the associated servo motors provided to drive primary and secondary paths of the continuous-path moulding machine enable any positional errors on primary and secondary paths to be corrected regularly and as necessary, within predetermined limits embedded in the customised software, before the positional errors drift sufficiently to cause operating problems. It is quite possible to establish a frequency of the correction process as high as 2000 times per second if desired, and for some purposes a frequency as low as 50 times per second can be adequate. The frequency of the correction process is not narrowly critical, except that lower frequencies mean less accuracy, and while high frequencies can be provided at little additional cost, the need to allow time for correction processes to take place is also a practical factor to be considered. For practical purposes, the frequency of the correction process may be within the range 50 and 2500 times per second for example, and more preferably between 1000 and 2000 times per second, for example, and encoders may be easily geared to provide between 150 and 600 pulses per millimetre of movement if desired, on primary and secondary paths for example.

By way of example, a frequency of the correction process of 1000 times per second on an experimental moulding machine with both a primary and a secondary continuous-path loop utilising encoders giving 300 pulses per millimetre of movement on both paths may be used. Surprisingly, it is possible to maintain easily the register of the transfer die axis which followed the secondary path with the moulding die axis which followed the primary path to within 0.5 millimetres whilst the moulding machine was producing articles. FIG. 1 shows the deviation of the transfer die axis following the secondary path from its correct register with the moulding die axis following the primary path expressed as a following error in millimetres versus time over a period of 20 minutes during which the moulding machine was operating producing articles. This tolerance is better than can be achieved with prior art machines with mechanically connected paths, especially once the cams and transmission trains on the prior art machines become worn, as they do after the machine has been in service for a time. An advantage of the invention is that by communicating with the DIOC in real time, while the machine is operating and producing articles, the positional relativity of primary and secondary paths is always known and may be adjusted more or less continuously so that not only can the adjustments include a constant offset adjustment, but a varying offset adjustment may also be included to suit the running characteristics of particular dies installed on the continuous-path moulding machine for a particular production run, especially if all of the dies installed on the machine are not identical. It also becomes possible to "tune" the machine so that different weight products can be produced from identical dies installed on the machine, and the product weight can be confirmed or corrected by providing a feedback signal to a DIOC from an automatic weighing station on a production line. Every combination of moulding or forming die and transfer die can be individually "tuned" to obtain optimum quality of the moulded article, while the continuous-path moulding machine is in operation. Once "tuned" moulding machines according to this invention will operate for very extended periods, using self correcting provisions conveniently represented by the "if-then" type instructions contained in the customised software associated with the at least one DIOC. Furthermore, the continuous-path moulding machine may be simply monitored from a remote location by means of a modem connected to a DIOC and if desired adjustments can be made to the customised software to change the machine performance to suit, without the need to even visit the operating installation.

In a further embodiment of this invention the assemblies or components of the assemblies moving continuously or stepwise forward on either a primary or a secondary path may have their positions altered by a linkage or gearbox or the like connected to a motor operating in closed loop servo mode and itself moving with the said assemblies or components of the assemblies on a path of the continuous-path moulding machine. Essential to this embodiment is the communication system by which the servo loop is closed between the stationary elements of the servo loop such as the DIOC and the moving elements such as the motor, and the servo amplifier which may be either stationary or installed on a path. Assemblies or components may also all move relative to the stationary framework of an operating continuous-path moulding machine, in which case the essential communication system as described hereinbefore enables communications between components moving relative to each other on a path of the operating continuous-path moulding machine.

Another advantage of continuous-path moulding machines of the invention is that the mass of the components can be significantly reduced, thus reducing the cost of the machine, simplifying its installation, and it also becomes feasible to even change whole assemblies, such as to quickly change a rotor assembly for example to match production requirements or for refurbishment of components. The moulding machines become more versatile and particularly economic to produce compared with prior art moulding machines, and for certain applications it becomes feasible to include a second rotor assembly in the facility, so that the rotors may be changed quickly to another with different characteristics or component assemblies or mounted die sets if desired.

The digital input/output controller device, the DIOC (as defined herein), may comprise a common personal computer commonly referred to as a PC in the art or several of them connected together to allow data transfer between them, and wherein at least one of the PC's is fitted with one or more suitable data acquisition and control input/output cards to allow receiving of the signals representing the discrete reference positions on the primary or a secondary path of the continuous-path moulding machine, and signals from the continuous-path moulding machine peripheral supporting equipment, such as pumps, air and hydraulic cylinders, valves, motors, heaters, switches and sensors for example. When reference is made to a PC (personal computer) also included in the term are, versions of computers adapted for industrial use, containing the essential central processing unit (CPU) and backplane or motherboard as well known in the art. The signals received by the PC or PC's in turn, depending upon the customised software and the "if-then" type instructions (as defined herein) contained in the customised software initiate output signals from the DIOC to be transmitted back to the continuous-path moulding machine by way of the at least one communication system to co-ordinate functions between components on the primary path and components on a secondary path of the continuous-path moulding machine, as well as receiving input signals from peripheral supporting equipment, and outputting signals to peripheral supporting equipment to initiate functions or modify settings therein.

In the invention fail-safe confirmation signals may also be provided by means of suitable switches or sensors, to enable confirmation signals to be returned to the DIOC either originating from the components on a path or from peripheral supporting equipment, to confirm that the components or devices associated with the continuous-path moulding machine have responded to the function or setting modification signals appropriately, and should this not be so, to take corrective action as predetermined by the customised software. Using this approach, with confirmation of functions, the components of the continuous-path moulding machine may be considerably reduced in mass, as there is no need to attempt to build them strong enough to withstand the serious consequences of loss of mechanical connection and mechanical breakdown as sometimes happens with prior art machines. Prior art machines can be damaged even by simple malfunctions such as failure to transfer an article from a moulding die for example, whereas moulding machines of the invention can detect the malfunction and make corrections while still operating, and with reduced risk of mechanical damage or breakdown. In this embodiment of the invention, the confirmation signals returned to the DIOC can also be used by the DIOC to time or otherwise monitor the actions of components or devices associated with the continuous-path moulding machine. The actions of said components can then be modified by the DIOC according to the predetermined customised software so that the operation of the continuous-path moulding machine remains optimised at all times.

By way of example, a continuous-path moulding machine which utilises pneumatic cylinders to extend transfer dies travelling on a secondary continuous-path loop in order to co-act with moulding dies travelling on a primary continuous-path loop can be operated. The exact position of the transfer die assemblies travelling on the secondary continuous-path loop can be monitored as given by a rotary encoder signal and the duration of the cylinder extension for each cylinder/transfer die assembly as given by the time interval between the positive edge of the signal to the valve controlling the cylinder extension and a confirmation signal from a proximity sensor detecting when the cylinder reaches full extension. Surprisingly, it is possible to achieve co-ordination of each transfer die assembly with its associated moulding die to within 1/100 second by simply advancing or retarding the signal to the valve controlling the cylinder extension with respect to the position of the assemblies travelling on the secondary continuous-path loop. The co-ordination is maintained for each individual transfer die assembly continuously despite changing motive air pressure and varying degrees of wear and friction in each transfer die assembly. This is an example of the extensive experimentation conducted and the precise management of a continuous-path moulding machine, which the invention is able to achieve.

A preferred form of the DIOC is the specialised form of a computer commonly known and referred to as a programmable logic controller or PLC which is readily available in a range of models, based upon a Central Processing Unit (CPU), and memory capability not unlike a personal computer.

Whether the DIOC be based upon one or more personal computers, or one or more programmable logic controllers, a very useful feature of the invention is the ability to interface a second device such as a personal computer (PC) to the DIOC to enable monitoring of the operating continuous-path moulding machine and to enable changes to be made to the software settings (the "if-then" type statements as defined herein) even while the continuous-path moulding machine continues to run and manufacture articles. In this way changes can be made to the operating parameters to optimise the process on-the-run, such changes being impossible on prior art continuous-path moulding machines unless the machine is shut down and fitted with new cams for example as explained hereinbefore. The ability in the invention to make changes to the operating parameters on-the-run is a very considerable advancement over the prior art.

In the invention, by experiment, one or more continuous-path moulding machines can be effectively monitored and controlled from a distant site such as a central control office using a telephone or radio link. In this form of the invention the essential DIOC or the second device such as a personal computer (PC) when used may be interfaced with a telephone or radio link using a modem to a personal computer (PC) at the distant site, enabling the continuous-path moulding machine to be effectively monitored and controlled from the distant site. In experiments it is possible to monitor and control an operating continuous-path moulding machine without operator intervention at the manufacturing site for several days, until such times as the manufacturing run was complete and it was necessary to change the moulding dies to manufacture different articles.

In the invention a continuous-path moulding machine includes components moving on at least one primary path and at least one secondary path wherein at least one path is a continuous-path loop, at least one moulding or forming die moving continuously or stepwise forward on a primary path, and at least one transfer or pressing die moving continuously or stepwise on a secondary path. Usually a plurality of moulding or forming dies are provided on the primary path and usually the primary path is a continuous-path loop as in the common form of prior art moulding machine. Due to the at least one position defining signal transmitted to the at least one DIOC from the primary path it is possible to know the position of all the components, such as a plurality of moulding or forming dies on the primary path at any time while the continuous-path moulding machine is in operation. This provides considerable advantages in the invention in comparison with the prior art since it becomes possible to operate every moulding or forming die installed on the continuous-path moulding machine uniquely, to suit that dies characteristics. The dies in a production run need not even be a matched set and may each have quite different operating characteristics since each can be managed separately on the operating moulding machine simply by using the customised software in conjunction with the DIOC. Because the movement forward on the primary path may be continuous or intermittent due to the simplicity of control used in the invention it even becomes possible to include deep cavity moulding or forming dies along with shallow cavity moulding or forming dies in the same manufacturing run on the machine. The prior art limitations as to cavity depth due to interference between moulding and transfer dies as they enter and leave cavities are very simply and effectively overcome in the invention by use of the intermittent or stepwise forward motion option provided by the novel means used to control the continuous-path moulding machine according to the invention. Components such as moulding or forming dies may be stopped at a precise position in a step-wise motion sequence and product transfer and/or pressing for example may be accomplished from a deep cavity in a moulding or forming die while a die is stationary for a time sufficient to enable a transfer die to co-act with a moulding die to effect removal and transfer of a moulded article.

The provision of discrete reference positions on the primary path, and the generation of at least one position defining signal relating to the position status of the primary path enables a secondary path or paths to be simply and effectively co-ordinated with the primary path, employing the at least one DIOC together with the customised software containing "if-then" type instructions and the communication system, to enable signals to be communicated to secondary paths of the continuous-path moulding machine, and servo loops to be established so that the paths of the continuous-path moulding machine can be co-ordinated and any operations relating to the proper co-acting functioning of components on different paths to be accomplished during operation of a continuous-path moulding machine.

The invention has been described by way of example only, and is not limited to any particular materials or configuration, other than as described herein, and to those skilled in the art various equivalents will become apparent which are to be included.

What is claimed is:

1. A continuous-path moulding machine for manufacture of moulded articles, including at least one moulding or forming die moving continuously or stepwise forward on a primary path and at least one transfer or pressing die moving continuously or stepwise forward on a secondary path, and wherein at least one said path is a continuous-path loop, the arrangement being such that a component on said continuous-path loop passes a given fixed point on said continuous-path loop repeatedly, and wherein a plurality of discrete reference positions are provided on at least said primary path, and wherein said discrete reference positions generate at least one position defining signal on said primary path, and wherein said at least one position defining signal is transmitted to at least one DIOC, and wherein said DIOC includes associated customised software containing "if-then" type instructions, and wherein at least one communication system is provided to enable signals to be communicated from a stationary component of said continuous-path moulding machine to at least one component on a path of said continuous-path moulding machine to maintain real time relationship and positional control between said at least one moulding or forming die on a primary path and said at least one transfer or pressing die on a secondary path while said continuous-path moulding machine is operating to produce moulded articles.

2. The continuous-path moulding machine of claim 1, wherein said primary path is a continuous-path loop.

3. The continuous-path moulding machine of claim 1, wherein said secondary path is a continuous-path loop.

4. The continuous-path moulding machine of claim 1, wherein a plurality of discrete reference positions are provided on said secondary path, and wherein said discrete reference positions generate at least one position defining signal, and where said at least one position defining signal is transmitted to at least one DIOC, and wherein said at least one DIOC includes associated customised software containing "if-then" type instructions.

5. The continuous-path moulding machine of claim 4, wherein said at least one DIOC receives at least one position defining signal transmitted from a primary path of said continuous-path moulding machine and at least one position defining signal transmitted from a secondary path of said continuous-path moulding machine.

6. The continuous-path moulding machine of claim 1, wherein said communication system is selected from a slip-ring system, a rail and conducting brush or shoe system, a slip-disk and conducting brush system, an infra-red or visible spectra light beam system, or a radio frequency signal system.

7. The continuous-path moulding machine of claim 6, wherein said communication system is a slip-ring or slip-disk system.

8. The continuous-path moulding machine of claim 1, wherein said discrete reference positions are identified one from another reference position.

9. The continuous-path moulding machine of claim 8, wherein said discrete reference positions are identified one from another reference position by counting each reference position from a datum or base reference position.

10. The continuous-path moulding machine of claim 1, including at least one primary continuous-path loop and at least one secondary continuous-path loop, wherein discrete reference positions are provided by at least one encoding device associated with each of a primary continuous-path loop and a secondary continuous-path loop to generate a plurality of position defining signals from said at least one encoding device associated with each continuous-path loop and wherein said position defining signals are input to and sampled at substantially predetermined intervals by at least one common DIOC, said common DIOC including customised software containing "if-then" type instructions, and wherein positional errors between a primary continuous-path loop and a secondary continuous-path loop are determined by comparisons between actual positions as indicated by said position defining signals and target positions as defined in said customised software, said positional errors initiating a response of output correction signals at a substantially predetermined interval frequency to closed servo loop operating system including servo amplifiers driving associated servo motors on both a primary continuous-path loop and a secondary continuous-path loop to maintain real time relationship and positional control between a primary continuous-path loop and a secondary continuous-path loop of said continuous-path moulding machine while said continuous-path moulding machine is operating to produce articles.

11. The continuous-path moulding machine of claim 1, further comprising an automatic weighing station arranged to measure a weight of individual articles produced by the machine, the automatic weighing station being in communication with the DIOC such that the DIOC may induce the machine to individually monitor and control the produced weight of individual articles.

12. The continuous-path moulding machine of claim 1, further comprising a control device in communication with the DIOC such that at least one of the control device and the DIOC can independently monitor and control operation of the machine.

13. The continuous-path moulding machine of claim 12, wherein the control device is remotely located from the primary and the secondary paths.

14. The continuous-path moulding machine of claim 1, further comprising a fail-safe system in communication with the DIOC and arranged to provide a warning signal to the DIOC in case of malfunction of the machine.

* * * * *